United States Patent [19]

Campbell

[11] 4,194,514

[45] Mar. 25, 1980

[54] REMOVAL OF RADIOACTIVE LEAD AND POLONIUM FROM TOBACCO

[75] Inventor: Ramsey G. Campbell, Berkeley, Calif.

[73] Assignee: Stauffer Chemical Company, Westport, Conn.

[21] Appl. No.: 726,388

[22] Filed: Sep. 27, 1976

[51] Int. Cl.[2] ..... A24B 15/02; A24B 15/04

[52] U.S. Cl. ..... 131/17 R; 131/140 B

[58] Field of Search ..... 131/17 R, 140 R, 140 A, 131/140 B, 143; 71/39, 113, 78

[56] References Cited

U.S. PATENT DOCUMENTS

| | | | |
|---|---|---|---|
| 158,015 | 12/1874 | Barton | 131/143 |
| 587,184 | 7/1897 | Cohen | 131/143 |
| 3,327,716 | 6/1967 | Kohan et al. | 131/140 R |
| 3,403,688 | 10/1968 | Kahane et al. | 131/140 R |

OTHER PUBLICATIONS

*Chemistry of the Rare Radio Elements* by Bagnall Academic Press Inc., New York, New York, 1957; p. 49 cited.

*Primary Examiner*—V. Millin

*Attorney, Agent, or Firm*—M. Henry Heines; Edith A. Rice

[57] ABSTRACT

Radioactive lead and polonium can be removed from tobacco by treating uncured tobacco leaves with a dilute acid solution. The solution can also contain hydrogen peroxide and/or a wetting agent.

39 Claims, No Drawings

REMOVAL OF RADIOACTIVE LEAD AND POLONIUM FROM TOBACCO

BACKGROUND OF THE INVENTION

This invention relates to the removal of radioactive lead and polonium from tobacco.

It has been reported that tobacco and tobacco products, such as cigarettes contain radioactive lead and polonium. One explanation for the presence of these radioactive elements in tobacco is the accumulation of submicron atmospheric particles containing these elements on the sticky exudate of the glandular heads of the hairlike trichomes which protrude from the tobacco leaves. The radioactive materials then diffuse into the open cellular structure of the glandular heads. During curing of the tobacco, the exudate is thought to polymerize into an insoluble substance encapsulating the trichomes. See Edward A. Martell, "Radioactivity of Tobacco Trichomes and Insoluble Cigarette Smoke Particles" published in *Nature,* Vol. 249 No. 5454, pp. 215–217, May 17, 1974. Other modes of entry into the tobacco plant, for example, root uptake from the soil and deposition from rainfall, have also been proposed. Studies have also shown that the radioactive metals have been detected in cigarette smoke and in bronchial tissue sites in smokers at higher concentrations than in non-smokers. From this it is speculated that the radioactive elements in tobacco might be a contributing factor to cancer and arteriosclerosis. See Edward A. Martell, "Tobacco Radioactivity and Cancer in Smokers," *American Scientist,* Vol. 62, No. 4, July–August 1975, pp. 404–412.

Treatment of tobacco to remove potentially harmful chemicals has been an active area of research in recent years. Most of this work has been directed to the reduction of tar and nicotine in tobacco. Some work has been directed to removal of other chemicals such as phenols, benzo (α) pyrene and metal carbonyls. U.S. Pat. No. 3,246,654 to Oliver W. Burke, Jr., Apr. 17, 1966, relates to removing metal carbonyls from tobacco smoke by contacting the smoke with organic phosphorus compounds. Sugita and Yoshizawa teach in Nippon Senbai Kosha Chuo Kenkusho Kenkyu Hokoku No. 108, 313–17 CA:66 559h that the nicotine content of tobacco leaves can be reduced by dipping the leaves in a 0.35% solution of various chemicals for two minutes. The chemicals reported to have been used are ammonium and sodium polyphosphates. U.S. Pat. No. 3,577,997 to M.A.H. Bindig, May 11, 1971, relates to removing benzo (α) pyrene by treating tobacco with an aqueous solution of citric acid and deuterium oxide. The treatment is conducted by spraying the solution onto cured, shredded tobacco. W. A. Smith reports in *Queensland Journal of Agriculture Science,* Vol. 16, No. 3pp (September 1959) that excessive arsenic residues resulting from the use of lead arsenic insecticide were removed from green tobacco leaves by dipping the leaves in 0.25% hydrochloric acid containing 0.25% of a secondary alkyl sulfate detergent. Smith goes on to report that other factors would limit commercial use of this method, and that the treated tobacco leaves were distinctly papery.

Description of the Invention

It has now been found that radioactive lead and polonium can be removed from uncured tobacco leaves using dilute acid solution without damaging the leaves.

Accordingly, this invention comprises the process of removing radioactive lead and polonium from tobacco leaves by treating said tobacco leaves with an aqueous solution containing from about 0.01% to about 1.0% by weight of an acid. Preferably, the solution also contains about 0.01% to about 5.0% by weight of hydrogen peroxide. Other additives, such as wetting agents, stabilizers and the like can also be included, if desired.

The tobacco leaves can be treated in accordance with this invention at any time prior to curing the leaves. In a preferred embodiment the dilute acid solution is sprayed on the tobacco plants while they are still growing. The amount of solution sprayed onto the plants should be sufficient to wet the entire surface area of the individual tobacco leaves. After the spray has been applied, the leaves are permitted to air dry. One or more additional spray applications can be effected to ensure optimum removal of radioactive lead and polonium. After the leaves have dried following treatment with the acid solution, it is preferred to wash the leaves with fresh water to remove any residual acid and deposits formed during the treatment. Sufficient natural rainfall while the plants are still growing after treatment with the acid solution will remove residual acid and deposits, making a separate washing step unnecessary.

The tobacco leaves can also be treated in accordance with this invention following harvest. After the leaves and/or the whole tobacco plants have been harvested, they are customarily strung on a tobacco stick to be hung in the curing barns for subsequent air, flue, or fire curing. Before the curing process is started the leaves can be treated with the acid solution by dipping the leaves into the solution before hanging them in the curing barns, or alternatively, the hanging leaves can be sprayed with the acid solution. After the leaves have been treated with the acid solution they should be washed with fresh water to remove residual action and deposits.

When the leaves are dipped into the solution the length of time they are in contact with the solution is not critical as long as the entire leaf surface is submerged. The longer the contact time the more completely the radioactive elements will be removed. However, depending on the concentration of the acid, longer contact times can result in damage to the tobacco leaves. Contact times of less than one hour are preferred and times as low as one second are effective. When the concentrations of the acid is greater than about 1% by weight, surface damage to the leaf is likely to occur. Thus, it is preferred to use a solution containing about 0.01% to about 1.0% by weight of acid. The most preferred concentration of acid in the treating solution is from about 0.03% to about 0.8% by weight.

The acid used can be organic, inorganic or mixtures of such acids. Illustrative examples of inorganic acids are nitric acid, hydrochloric acid, hydrobromic acid, perchloric acid, sulfuric acid, hydrofluoric acid, fluorosilicic acid and the like and mixtures thereof. Illustrative examples of organic acids include acetic acid, citric acid, lactic acid, tartaric acid, methane sulfonic acid, benzene sulfonic acid, formic acid, glycollic acid, chloroacetic acid, propionic acid, peracetic acid, and the like and mixtures thereof.

The addition of hydrogen peroxide to the treating solution assists in the removal of radioactive lead and polonium from the tobacco leaves. It is preferred to use an aqueous solution containing from about 0.01% to about 1.0% by weight of acid and from about 0.01% to about 5.0% by weight of hydrogen peroxide. The amount of hydrogen peroxide used is preferably from about 0.03% to about 3.0% by weight.

When hydrogen peroxide is employed in the acid solution, a stabilizer can also be included, if desired. Stabilizers useful in stabilizing acid-hydrogen peroxide solutions include acetanilide, phenol, paramethoxyphenol, alkyl alcohols, glycerine, and bis-1,4-butenediol.

A wetting agent can also be employed if desired to facilitate wetting of the leaf surface with the solution. The use of a wetting agent is beneficial but not essential and generally about 0.001% to about 0.4% by weight, preferably about 0.05% to about 0.2% by weight will be employed.

Wetting agents that can be used include anionic, nonionic and cationic wetting agents and mixtures thereof. Illustrative examples of wetting agents include sulfonic acids and salts such as alkyl benzene sulfonates, petroleum sulfonates, perfluoroalkyl sulfonates, dialkyl sulfosuccinates and naphthalene sulfonates, sulfuric acid esters, such as alkyl sulfates, sulfated alcohols and sulfated alkyl phenols, phosphate esters such as alkyl orthophosphates, and alkylpolyphosphates, polyoxyethylene surfactants, ethoxylated alkylphenols, ethoxylated aliphatic alcohols, aliphatic mono-, di-, and polyamines, alkylbenzyldimethyl ammonium chlorides and the like. A listing of commercially available wetting agents can be found in McCutcheon's *Detergents and Emulsifiers,* 1973 North American Edition, Allured Publishing Corporation, Ridgewood, N.J.

The following examples illustrate the removal of radioactive lead and polonium from tobacco leaves by the process of this invention.

EXAMPLE 1

A solution of 1 gallon water, 4 cubic centimeters of 70% nitric acid, 11 cubic centimeters of 30% hydrogen peroxide, 2 cubic centimeters of octylphenoxypolyethoxy ethanol (a commercially available wetting agent sold under the trademark Triton® X-114) and 10 cubic centimeters of 10% Fluorad® FC-95 (a potassium perfluoroalkyl sulfonate commercially available from the Minnesota, Mining and Manufacturing Company) was prepared and poured into a stainless steel sprayer. The leaves of two growing tobacco plants were sprayed with the solution using about half the solution on each plant. After about one hour the leaves of the first plant were dry and then were sprayed with water and again permitted to dry. The dried leaves were removed from the plant. No evidence of leaf damage was observed.

About one hour after spraying with the solution, the leaves of the second plant were dry and were then sprayed with a second solution containing the same concentrations of acid, hydrogen peroxide and wetting agents. The plant was permitted to dry and after about one hour was sprayed with water. After the plant had dried the leaves were removed from the plant. No evidence of leaf damage was observed.

The leaves from each plant were analyzed for radioactive lead ($^{210}Pb$) as follows:

The dried leaves, with stems removed, were placed in a one liter beaker and further dried at 100° C. for about four hours. A 10.00 gram sample of tobacco from each group was placed in a one liter beaker containing 200 cubic centimeters 70% nitric acid and heated at boiling temperature to digest the tobacco. When the volume of the digestion solution was reduced by about half, it was transferred to 150 milliliter beaker and further concentrated by boiling to a volume of 20 milliliters. The resulting solutions were analyzed for radioactive lead ($^{210}Pb$) by the following bismuth 210 ($^{210}Bi$) ingrowth analytical method.

The sample was equilibrated with Pb carrier and decontaminated with lead diiodide and lead nitrate precipitations. The 210Bi daughter was removed by a lead sulfate precipitation, and the resulting yield of lead sulfate was determined from the $^{210}Bi$ daughter ingrowth after a period of two weeks. The purity of the sample was verified by plotting the $^{210}Bi$ ingrowth over a period of two weeks. The results, in picoCuries per gram (pCi/g), are shown in Table I and compared to the results of radioactive lead analyses of two commercial tobacco products and an untreated sample from the same tobacco crop as the two treated plants.

EXAMPLE 2

The procedure of Example 1 was repeated using two additional tobacco plants and a treatment solution containing 0.3% nitric acid, 0.3% hydrogen peroxide and the wetting agent mixture. Leaves of the plant sprayed once showed no damage. Minor leaf damage was observed on the plant sprayed twice.

The results of $^{210}Pb$ analyses of the leaves treated in this example are also reported in Table I.

EXAMPLE 3

The procedure of Example 1 was repeated using one tobacco plant, and spraying once with a treatment solution containing 1% nitric acid, 0.5% hydrogen peroxide and the wetting agent mixture. After harvesting, moderate leaf damage was observed.

The result of the $^{210}Pb$ analysis of the leaves from the treated plant is also reported in Table I.

TABLE I

| Example | Acid | Hydrogen Peroxide | Wetting Agent | $^{210}Pb$ (pCi/g) |
|---|---|---|---|---|
| Commercial Sample A | — | — | — | 0.39±0.07[1] |
| Commercial Sample B | — | — | — | 0.43±0.07 |
| Untreated Sample | — | — | — | 0.33±0.06 |
| Example 1 (Plant 1 1 spray) | 0.1% nitric acid | 0.1% | yes | 0±0.09 |
| (Plant 2 2 sprays) | 0.1% nitric acid | 0.1% | yes | 0±0.07 |
| Example 2 (Plant 1 1 spray) | 0.3% nitric acid | 0.3% | yes | 0.05±0.05 |
| (Plant 2 2 sprays) | 0.3% nitric acid | 0.3% | yes | 0.09±0.04 |
| Example 3 | 1.0% nitric acid | 0.5% | yes | 0±0.10 |

[1]Standard Deviation due to counting statistics.

EXAMPLES 4–16

Treatment solutions were prepared by adding to 4 gallons of water, acid, hydrogen peroxide and/or wetting agent in amounts to give solutions of the concentrations specified in Table II. The same wetting agent mixture used in Examples 1–3 was employed in these examples. A group of four tobacco leaves selected at random was immersed in each treating solution for one hour and agitated at five minute intervals. At the end of one hour the leaves were removed from the treating solution and washed by dipping them in four gallons of fresh water. The leaves were then permitted to dry. The treated leaves were digested and analyzed for $^{210}Pb$ as described in Example 1. The results, in picoCuries per gram (pCi/g), are reported in Table II.

TABLE II

| Example | Acid | Hydrogen Peroxide | Wetting Agent | $^{210}Pb$ (pCi/g) |
|---|---|---|---|---|
| Control | — | — | — | 0.28±0.04[2] |
| 4 | — | — | yes | 0.16±0.04 |
| 5 | — | 0.3% | yes | 0.11±0.05 |
| 6 | 0.1% nitric acid | 0.1% | no | 0±0.07 |
| 7 | 0.1% nitric acid | 0.1% | yes | 0.09±0.04 |
| 8 | 0.3% nitric acid | — | yes | 0±0.3 |
| 9 | 0.3% nitric acid | 0.3% | yes | 0.07±0.04 |
| 10[1] | 1% nitric acid | 0.6% | yes | 0±0.06 |
| 11 | 1% acetic acid | 0.3% | yes | 0.07±0.03 |
| 12 | 1% acetic acid | — | yes | 0±0.07 |
| 13 | 0.2% hydrochloric acid | 0.3% | yes | 0±0.08 |
| 14 | 0.2% hydrochloric acid | — | yes | 0±0.08 |
| 15 | 0.3% formic acid | 0.3% | yes | 0±0.2 |
| 16 | 0.5% perchloric acid | 0.3% | yes | 0±0.07 |

[1]Leaves after treatment were limp and brownish.
[2]Standard Deviation due to counting statistics.

EXAMPLES 17–26

The procedure of treating groups of four leaves as set forth in Examples 4–16 was repeated using the treating solutions identified in Table III. Following treatment the leaves were dried and digested as described above and analyzed for polonium 210 ($^{210}Po$) content as follows:

The sample was further digested with hydrogen peroxide and equilibrated with $^{208}Po$ tracer. The $^{210}Po$ was purified with ferric hydroxide precipitations, extraction with isopropyl acetone, and contact with a cation exchange resin. The purified $^{210}Po$ was electrodeposited on a platinum disc and the disc counted for $^{210}Po$ by alpha pulse height spectroscopy. The radiochemical yield was determined by the $^{208}Po$ recovery. The results, reported in picoCuries per gram (pCi/g), are shown in Table III.

TABLE III

| Example | Acid | Hydrogen Peroxide | Wetting Agent | $^{210}Po$ (pCi/g) | % Error |
|---|---|---|---|---|---|
| 14 | — | — | no | 0.068 | ±11 |
| 15 | — | — | yes | 0.030 | ±16 |
| 16 | 0.1% nitric acid | 0.1% | yes | 0.030 | ±2.3 |
| 17 | 0.3% nitric acid | 0.3% | yes | 0.021 | ±13 |
| 18 | 0.3% nitric acid | — | yes | 0.021 | ±15 |
| 19[1] | 1% nitric acid | 0.6% | yes | 0.014 | ±19 |
| 20 | 1% acetic acid | 0.3% | yes | 0.029 | ±20 |
| 21 | 0.2% hydrochloric acid | 0.3% | yes | 0.025 | ±23 |
| 22 | 0.3% formic acid | 0.3% | yes | 0.018 | ±15 |
| 23 | 0.5% perchloric acid | 0.3% | yes | 0.020 | ±18 |

[1]Leaves after treatment were limp and brownish.

As can be seen from the above data, treatment of tobacco leaves in accordance with this invention yields tobacco leaves having a radioactive lead content of less than about 0.09 picoCuries per gram and less than about 0.03 picoCuries per gram of polonium. The treated tobacco leaves can be cured and processed in any conventional manner to produce tobacco products, such as cigars, cigarettes, pipe tobacco, and the like, having reduced radioactive lead and polonium content.

What is claimed is:

1. A process for reducing the radioactive lead and polonium content of tobacco which comprises treating uncured tobacco leaves with an aqueous solution containing about 0.01% to about 1.0% by weight of an acid.

2. The process set forth in claim 1 wherein said acid is nitric acid.

3. The process set forth in claim 1 wherein said acid is hydrochloric acid.

4. The process set forth in claim 1 wherein said acid is acetic acid.

5. The process set forth in claim 1 wherein said acid is formic acid.

6. The process set forth in claim 1 wherein said acid is perchloric acid.

7. The process set forth in claim 1 wherein said aqueous solution also contains about 0.01% to about 5.0% by weight of hydrogen peroxide.

8. The process set forth in claim 7 wherein said acid is nitric acid.

9. The process set forth in claim 7 wherein said acid is hydrochloric acid.

10. The process set forth in claim 7 wherein said acid is acetic acid.

11. The process set forth in claim 7 wherein said acid is formic acid.

12. The process set forth in claim 7 wherein said acid is perchloric acid.

13. The process set forth in claim 7 wherein said aqueous solution also contains about 0.01% to about 0.4% by weight of a wetting agent.

14. The process set forth in claim 13 wherein said acid is nitric acid.

15. The process set forth in claim 13 wherein said acid is hydrochloric acid.

16. The process set forth in claim 13 wherein said acid is acetic acid.

17. The process set forth in claim 13 wherein said acid is formic acid.

18. The process set forth in claim 13 wherein said acid is perchloric acid.

19. A process for reducing the radioactive lead and polonium content of tobacco which comprises spraying the tobacco leaves prior to curing at least once with an aqueous solution containing about 0.01% to about 1.0% by weight of an acid.

20. The process set forth in claim 19 wherein said acid is nitric acid.

21. The process set forth in claim 19 wherein said aqueous solution also contains about 0.01% to about 5.0% by weight hydrogen peroxide.

22. The process set forth in claim 21 wherein said acid is nitric acid.

23. The process of claim 21 wherein said aqueous solution also contains about 0.001% to about 0.4% by weight of a wetting agent.

24. The process set forth in claim 23 wherein said solution contains 0.3% by weight nitric acid, 0.3% by weight hydrogen peroxide, and 0.08% by weight of a wetting agent.

25. The process set forth in claim 23 wherein said solution contains 0.1% by weight nitric acid, 0.1% by weight hydrogen peroxide, and 0.08% by weight of a wetting agent.

26. A process for reducing the radioactive lead and polonium content of tobacco which comprises spraying the growing tobacco leaves prior to harvest at least once with an aqueous solution containing about 0.01% to about 1.0% by weight of an acid and permitting said leaves to dry.

27. The process set forth in claim 26 wherein said acid is nitric acid.

28. The process set forth in claim 26 wherein said aqueous solution also contains about 0.01% to about 5.0% by weight hydrogen peroxide.

29. The process set forth in claim 28 wherein said acid is nitric acid.

30. The process set forth in claim 29 wherein said solution contains 0.3% by weight nitric acid, 0.3% by weight hydrogen peroxide and 0.08% of a wetting agent.

31. The process set forth in claim 29 wherein said solution contains 0.1% by weight nitric acid, 0.1% by weight hydrogen peroxide, and 0.08% of a wetting agent.

32. The process of manufacturing a tobacco product, the improvement which comprises utilizing tobacco which has been treated after harvesting but prior to curing with an aqueous solution containing about 0.01% to about 1.0% by weight of an acid to reduce the radioactive lead and polonium content.

33. The process set forth in claim 32 wherein the tobacco product is a cigarette.

34. The process set forth in claim 32 wherein the tobacco product is a cigar.

35. The process set forth in claim 32 wherein the tobacco product is pipe tobacco.

36. The process set forth in claim 32 wherein said aqueous solution also contains from about 0.01% to about 5.0% by weight of hydrogen peroxide.

37. The process set forth in claim 36 wherein said aqueous solution contains about 0.01% to about 1.0% by weight of nitric acid, about 0.01% to about 5.0% by weight of hydrogen peroxide and about 0.001% to about 0.4% by weight of a wetting agent.

38. The product prepared by the process of claim 32.

39. An article of manufacture comprising a tobacco leaf containing less than about 0.09 picoCuries per gram of radioactive lead and less than about 0.03 picoCuries per gram of polonium.

* * * * *